US006403541B1

(12) United States Patent
Kambara et al.

(10) Patent No.: US 6,403,541 B1
(45) Date of Patent: Jun. 11, 2002

(54) OIL FILTER CLOGGING PREVENTING AGENT AND OIL FILTER CLOGGING PREVENTING METHOD, AND ENGINE OIL COMPOSITIONS COMPRISING SAID OIL FILTER CLOGGING PREVENTING AGENT

(75) Inventors: Yoshikuni Kambara, Uji; Hirotaka Tomizawa, Tokorozawa, both of (JP)

(73) Assignee: New Japan Chemical Co., Ltd., Kyoto (JP)

( * ) Notice: Subject to any disclaimer, the term of this patent is extended or adjusted under 35 U.S.C. 154(b) by 0 days.

(21) Appl. No.: 09/524,686

(22) Filed: Mar. 14, 2000

(30) Foreign Application Priority Data

Aug. 13, 1999 (JP) ..... 11-229361

(51) Int. Cl.[7] ..... C10M 129/16; C07C 43/00

(52) U.S. Cl. ..... 508/579; 568/678; 568/679; 568/680; 568/625

(58) Field of Search ..... 508/579; 568/678, 568/679, 680, 625

(56) References Cited

U.S. PATENT DOCUMENTS

| | | | | | |
|---|---|---|---|---|---|
| 2,880,175 | A | * | 3/1959 | Michaels et al. | 508/579 |
| 2,978,431 | A | * | 4/1961 | Engle | 508/579 |
| 3,674,902 | A | * | 7/1972 | Kalopissis et al. | 424/70 |
| 3,862,243 | A | * | 1/1975 | Bellos | 260/615 B |
| 4,217,390 | A | * | 8/1980 | Newkirk et al. | 428/395 |
| 4,302,349 | A | * | 11/1981 | Kosswig et al. | 252/174.21 |
| 4,317,940 | A | * | 3/1982 | Scardera et al. | 568/625 |
| 5,084,197 | A | * | 1/1992 | Galic et al. | 508/579 |
| 5,143,640 | A | * | 9/1992 | Moxey | 508/579 |
| 6,133,211 | A | * | 10/2000 | Cobianco et al. | 508/579 |

FOREIGN PATENT DOCUMENTS

| | | |
|---|---|---|
| EP | 736591 | 10/1996 |
| EP | 761804 | 3/1997 |
| GB | 1 417 590 | 12/1975 |
| JP | 48-74507 | 10/1973 |
| JP | 54-160401 | 12/1979 |
| JP | 59-25890 | 2/1984 |
| JP | 61-166892 | 7/1986 |
| JP | 4-202495 | 7/1992 |
| JP | 5-239485 | 9/1993 |
| JP | 8-176583 | 7/1996 |

* cited by examiner

*Primary Examiner*—Ellen M. McAvoy
(74) *Attorney, Agent, or Firm*—Armstrong, Westerman & Hattori, LLP

(57) ABSTRACT

Disclosed are a composition for preventing clogging of oil filters for various internal combustion engines, the composition comprising at least one hydroxyl-containing component selected from the group consisting of:

compounds represented by the formula (1)

$$R^1O—(R^2O)m—H \quad (1)$$

wherein $R^1$ is hydrogen or $C_1$ to $C_8$ alkyl, $R^2$ is $C_2$ to $C_{10}$ alkylene, m is an integer of 1 to 10, and when m is 2 or more, the two or more $R^2$ groups may be the same or different; and compounds represented by the formula (2)

(2)

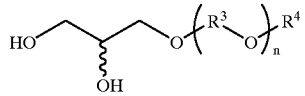

wherein $R^3$ is $C_2$ to $C_4$ alkylene, $R^4$ is hydrogen or $C_1$ to $C_{10}$ alkyl, n is an integer of 0 to 8, and when n is 2 or more, the two or more $R^3$ groups may be the same or different; a method for preventing oil filter clogging using the composition, and an engine oil composition containing the composition.

34 Claims, No Drawings

OIL FILTER CLOGGING PREVENTING AGENT AND OIL FILTER CLOGGING PREVENTING METHOD, AND ENGINE OIL COMPOSITIONS COMPRISING SAID OIL FILTER CLOGGING PREVENTING AGENT

TECHNICAL FIELD

The present invention relates to an agent capable of significantly alleviating oil filter clogging caused by water mixed in an engine oil, the agent comprising a nonionic surfactant or a hydroxyl-containing component; a method for preventing oil filter clogging using the agent; and an engine oil composition containing the agent.

PRIOR ART

Recent engines have higher output, improved fuel efficiency, and improved combustion process that meets exhaust gas regulations, and thus high performance characteristics are required of engine oils. For achieving the required performance characteristics, new techniques for formulating additives are necessary. Among the required performance characteristics is anti-clogging properties for oil filters.

Oil filter clogging occurs as follows: When moisture in a blowby gas is condensed and mixed in an engine oil, additives dissolved in the oil are affected, and separate from the oil or form foots-like or mayonnaise-like sludge, making the oil difficult to pass through the filter. Oil filter clogging obstructs oil circulation and is liable to cause troubles.

As an additive for preventing oil filter clogging, Japanese Unexamined Patent Publication No. 176583/1996 discloses a composition for improving demulsibility. Unexamined Patent Publication No. 176583/1996 discloses that demulsibility of diesel engine oils is improved by adding (A) an alkenyl succinimide or its derivative, (D) a surfactant and (C) calcium salicylate having a base number of at least 100 mg KOH/g, to a base stock which is a mineral oil or a synthetic oil or a mixture thereof.

Said publication discloses, as examples of the surfactant (D), polyoxyalkylamines wherein the alkyl group has 8–22 carbon atoms; polyoxyethylene alkyl or alkenyl ethers wherein the alkyl or alkenyl group has 10 to 20 carbon atoms; polyoxypropylene alkyl or alkenyl ethers wherein the alkyl or alkenyl group has 10 to 20 carbon atoms; polyoxyethylene alkylphenyl ethers wherein the alkyl group has 6 to 12 carbon atoms; and the like.

However, said publication discloses that the three components, i.e., (A) an alkenyl succinimide or its derivative, (D) a surfactant and (C) calcium salicylate having a base number of at least 100 mg KOH/g, are essential for improving demulsibility, and does not disclose that single use of the surfactant (D) is effective for improving demulsibility.

Further, among the surfactants disclosed as specific examples of the surfactant (D), only polyoxyethylene nonylphenyl ether is used in the working examples.

Moreover, even if demulsibility is improved, oil filter clogging occurs in many cases. For example, although the engine oil composition disclosed in Japanese Unexamined Patent Publication No. 176583/1996 can improve demulsibility, water is not removed from the composition and therefore separated water is liable to redisperse in the composition. It is presumed that the redispersed water will form foots-like sludge and makes it difficult to sufficiently prevent oil filter clogging. Consequently, an additive capable of inhibiting formation of foots-like or mayonnaise-like sludge would be extremely useful because such an additive would significantly alleviate oil filter clogging and solve the above problems.

DISCLOSURE OF THE INVENTION

In view of the above state of the prior art, an object of the present invention is to provide an agent for preventing oil filter clogging, the agent being capable of inhibiting formation of foots-like or mayonnaise-like sludge when water is mixed in an engine oil, to thereby significantly prevent oil filter clogging.

The present inventors carried out extensive research to achieve the above object, and found that a specific nonionic surfactant or a hydroxyl-containing component, when added to an engine oil, can significantly prevent oil filter clogging. The present invention has been accomplished based on this finding.

The present invention provides an agent for preventing oil filter clogging, the agent comprising at least one hydroxyl-containing component selected from the group consisting of:

polyoxyalkylene ethers represented by the formula (1)

$$R^1O—(R^2O)m—H \quad (1)$$

wherein $R^1$ is hydrogen or $C_1$ to $C_8$ alkyl, $R^2$ is $C_2$ to $C_{10}$ alkylene, m is an integer of 1 to 10, and when m is 2 or more, the two or more $R^2$ groups may be the same or different; and polyoxyalkylene glyceryl ethers represented by the formula (2)

(2)

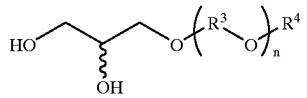

wherein $R^3$ is $C_2$ to $C_4$ alkylene, $R^4$ is hydrogen or $C_1$ to $C_{10}$ alkyl, n is an integer of 0 to 8, and when n is 2 or more, the two or more $R^3$ groups may be the same or different.

The present invention also provides an engine oil composition containing an agent for preventing oil filter clogging, the agent comprising at least one hydroxyl-containing component selected from the group consisting of:

polyoxyalkylene ethers represented by the formula (1)

$$R^1O—(R^2O)m—H \quad (1)$$

wherein $R^1$, $R^2$ and m are as defined above; and polyoxyalkylene glyceryl ethers represented by the formula (2)

(2)

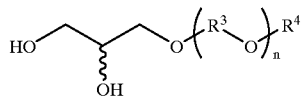

wherein $R^3$, $R^4$ and n are as defined above.

The present invention further provides a method for preventing oil filter clogging, the method comprising adding to an engine oil at least one hydroxyl-containing component selected from the group consisting of:

polyoxyalkylene ethers represented by the formula (1)

$$R^1O—(R^2O)m—H \quad (1)$$

wherein $R^1$, $R^2$ and m are as defined above; and polyoxyalkylene glyceryl ethers represented by the formula (2)

(2)

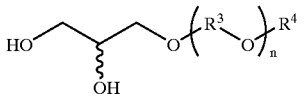

wherein $R^3$, $R^4$ and n are as defined above.

DETAILED DESCRIPTION OF THE INVENTION

Agent for Preventing Oil Filter Clogging

The agent for preventing oil filter clogging according to the present invention comprises at least one nonionic surfactant or hydroxyl-containing component selected from the group consisting of:

polyoxyalkylene ethers represented by the formula (1)

$$R^1O—(R^2O)m—H \quad (1)$$

wherein $R^1$, $R^2$ and m are as defined above; and polylxyalkylene glyceryl ethers represented by the formula (2)

(2)

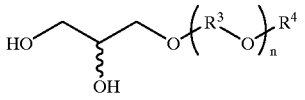

wherein $R^3$, $R^4$ and n are as defined above.

Polyoxyalkylene Ethers of the Formula (1)

In the polyoxylalkylene ethers represented by the formula (1), $R^1$ is hydrogen or $C_1$ to $C_8$ alkyl, m is an integer of 1 to 10, and $R^2$ may be the same or different and represents $C_2$ to $C_{10}$ alkylene. That is, $R^2$ represents $C_2$ to $C_{10}$ alkylene, and when m is 2 or more, the two or more $R^2$ groups may be the same or different.

It is recommended that $R^1$ is hydrogen, straight-chain $C_1$ to $C_8$ alkyl or branched-chain $C_3$ to $C_8$ alkyl.

Preferably, $R^1$ is hydrogen, straight-chain $C_1$ to $C_8$ alkyl or branched-chain $C_3$ to $C_8$ alkyl, such as methyl, ethyl, n-propyl, isopropyl, n-butyl, isobutyl, sec-butyl, n-pentyl, isopentyl, n-hexyl, isohexyl, n-heptyl, isoheptyl, 2-methylhexyl, n-octyl, 1-methylheptyl, 2-methylheptyl, 2-ethylhexyl, 2-octyl or isooctyl.

$R^2$ is, for example, straight-chain or branched-chain $C_2$ to $C_{10}$ alkylene, in particular straight-chain $C_2$ to $C_8$ alkylene or branched-chain $C_3$ to $C_8$ alkylene. The number of oxyalkylene group or groups represented by m is 1 to 10 and is sometimes expressed in terms of the average value.

Specific species of $C_2$ to $C_{10}$ alkylene represented by $R^2$ include ethylene, propylene, isopropyrene, butylene, isobutylene, pentylene, hexylene, octylene, nonylene, decylene and the like.

The polyoxyalkylene ethers represented by the formula (1) can be classified into polyoxyalkylene ethers represented by the formula (3)

$$R^5O—(R^6O)x—(R^7O)y—H \quad (3)$$

wherein $R^5$ has the same meaning as $R^1$; $R^6$ and $R^7$ may be the same or different and each represents $C_2$ to $C_4$ alkylene; and x and y may be the same or different and each are an integer of 0 to 10, provided that $1 \leqq x+y \leqq 10$; and polyoxyalkylene ethers represented by the formula (4)

$$R^8O—(R^9O)x1—(R^{10}O)z—(R^{11}O)y1—H \quad (4)$$

wherein $R^8$ has the same meaning as $R^1$; $R^9$ and $R^{11}$ may be the same or different and each represents $C_2$ to $C_4$ alkylene; $R^{10}$ is $C_5$ to $C_{10}$ alkylene; x1 and y1 are each an integer of 0 to 10, and z is an integer of 1 to 10, provided that $1 \leqq x1+y1+z \leqq 10$.

The polyoxyalkylene ethers represented by the formula (3) may be commercially available products, or can be easily prepared by conventional processes, for example, by a process comprising polymerizing or copolymerizing (i.e., adding or co-adding) at least one $C_2$ to $C_4$ alkylene oxide ($R^5$=H), or a process comprising polymerizing or copolymerizing at least one $C_2$ to $C_4$ alkylene oxide with a $C_1$ to $C_8$ alkanol ($R^5$=$C_1$ to $C_8$ alkyl).

The polyoxyalkylene ethers represented by the formula (4) may be commercially available products, or can be easily prepared by conventional processes, for example, by a process comprising:

1) reducing a $C_5$ to $C_{10}$ terminal dicarboxylic acid diester to obtain a terminal diol having a $C_5$ to $C_{10}$ alkylene group;
2) polymerizing (or copolymerizing) at least one $C_2$ to $C_4$ alkylene oxide with the terminal diol obtained in 1) above; or
3) subjecting the compound obtained in 1) or 2) and a $C_1$ to $C_{10}$ alkyl halide to an alkylation reaction in the presence of a basic catalyst.

In the polyoxyalkylene ethers of the formula (3), the following preferred combinations of $R^5$, $R^6$, $R^7$, x and y are recommended:

$R^5$=H, $R^6$=$C_2$ to $C_4$ alkylene, x=2 to 10 and y=0

$R^5$=H, $R^6$=ethylene, x=2 to 8 and y=0

$R^5$=H, $R^6$=propylene, x=2 to 8 and y=0

$R^5$=H, $R^6$=$C_2$ to $C_4$ alkylene, x=1 to 10, $R^7$=$C_2$ to $C_4$ alkylene, y=1 to 10, and $R^6$ and $R^7$ are different from each other, provided that $1 \leqq x+y \leqq 10$ $R^5$=$C_1$ to $C_8$ alkyl, $R^6$=$C_2$ to $C_4$ alkylene, x=1 to 10 and y=0

$R^5$=straight-chain $C_1$ to $C_8$ alkyl, $R^6$=ethylene, x=2 to 10 and y=0

$R^5$=branched-chain $C_3$ to $C_8$ alkyl, $R^6$=ethylene, x=2 to 10 and y=0

$R^5$=$C_1$ to $C_8$ alkyl, $R^6$=$C_2$ to $C_4$ alkylene, x=1 to 10, $R^7$=$C_2$ to $C_4$ alkylene, y=1 to 10, and $R^6$ and $R^7$ are different from each other, provided that $1 \leqq x+y \leqq 10$.

In the polyoxyalkylene ethers represented by the formula (4), the following preferred combinations of $R^8$, $R^9$, $R^{10}$, $R^{11}$, x1, y1 and z are recommended:

$R^8$=H, $R^{10}$=$C_5$ to $C_8$ alkylene, z=1 to 4 and x1=y1=0

$R^8$=H, $R^{10}$=straight-chain $C_5$ to $C_8$ alkylene, z=1 to 4 and x1=y1=0

$R^8$=H, $R^{10}$=branched-chain $C_5$ to $C_8$ alkylene, z=1 to 4 and x1=y1=0

$R^8$=$C_1$ to $C_8$ alkyl, $R^{10}$=$C_5$ to $C_8$ alkylene, z=1 to 4 and x1=y1=0.

Specific examples of polyoxyalkylene ethers represented by the formula (3) include the following, wherein EO indicates ethylene oxide and PO indicates propylene oxide.

Specific examples of polyoxyalkylene glycols represented by the formula (3) wherein $R^5$ is hydrogen include ethylene glycol, diethylene glycol, triethylene glycol, tetraethylene glycol, pentaethylene glycol, hexaethylene glycol, heptaethylene glycol, octaethylene glycol, nonaethylene glycol, decaethylene glycol, propylene glycol, dipropylene glycol, tripropylene glycol, tetrapropylene glycol, pentapropylene glycol, hexapropylene glycol, heptapropylene glycol, octapropylene glycol, nonapropylene glycol, decapropylene glycol, butanediol, dibutanediol, tributanediol, tetrabutanediol, pentabutanediol, hexabutanediol, heptabutanediol, octabutanediol, nonabutanediol, decabutanediol and the like.

Examples of polyoxyalkylene ethers represented by the formula (3) wherein $R^5$ is $C_1$ to $C_8$ alkyl include ethylene glycol monomethyl ether, diethylene glycol monomethyl ether, triethylene glycol monomethyl ether, tetraethylene glycol monomethyl ether, pentaethylene glycol monomethyl ether, polyoxyethylene (the number of moles of EO added=6 to 10) monomethyl ether, ethylene glycol monoethyl ether, diethylene glycol monoethyl ether, triethylene glycol monoethyl ether, tetraethylene glycol monomethyl ether, pentaethylene glycol monoethyl ether, polyoxyethylene (the number of moles of EO added=6 to 10) monoethyl ether, ethylene glycol monopropyl ether, diethylene glycol monopropyl ether, triethylene glycol monopropyl ether, polyoxyethylene (the number of moles of EO added=4 to 10) monopropyl ether, ethylene glycol monoisopropyl ether, diethylene glycol monoisopropyl ether, triethylene glycol monoisopropyl ether, polyoxyethylene (the number of moles of EO added=4 to 10) monoisopropyl ether, ethylene glycol monobutyl ether, diethylene glycol monobutyl ether, triethylene glycol monobutyl ether, polyoxyethylene (the number of moles of EO added=4 to 10) monobutyl ether, ethylene glycol monoisobutyl ether, diethylene glycol monoisobutyl ether, triethylene glycol monoisobutyl ether, polyoxyethylene (the number of moles of EO added=4 to 10) monoisobutyl ether, ethylene glycol monohexyl ether, diethylene glycol monohexyl ether, triethylene glycol monohexyl ether, polyoxyethylene (the number of moles of EO added=4 to 10) monohexyl ether, ethylene glycol mono(2-ethylhexyl) ether, diethylene glycol mono(2-ethylhexyl) ether, triethylene glycol mono(2-ethylhexyl) ether, polyoxyethylene (the number of moles of EO added=4 to 10) 2-ethylhexyl ether, polyoxyethylene (the number of moles of EO added=1 to 10) octyl ether, propylene glycol monomethyl ether, dipropylene glycol monomethyl ether, polyoxypropylene (the number of moles of PO added=3 to 10) monomethyl ether, propylene glycol monoethyl ether, dipropylene glycol monoethyl ether, propylene glycol monopropyl ether, dipropylene glycol monopropyl ether, polyoxypropylene (the number of moles of PO added=4 to 10) monopropyl ether, propylene glycol monoisopropyl ether, dipropylene glycol monoisopropyl ether, triethylene glycol monoisopropyl ether, polyoxypropylene (the number of moles of PO added=4 to 10) monoisopropyl ether, propylene glycol monobutyl ether, dipropylene glycol monobutyl ether, tripropylene glycol monobutyl ether, polyoxypropylene (the number of moles of PO added=4 to 10) monobutyl ether, propylene glycol monoisobutyl ether, tripropylene glycol monoisobutyl ether, polyoxypropylene (the number of moles of PO added=4 to 10) monoisobutyl ether, propylene glycol monohexyl ether, dipropylene glycol monohexyl ether, tripropylene glycol monohexyl ether, polyoxypropylene (the number of moles of PO added=4 to 10) monohexyl ether, propylene glycol mono(2-ethylhexyl) ether, dipropylene glycol mono(2-ethylhexyl) ether, tripropylene glycol mono(2-ethylhexyl) ether, polyoxypropylene (the number of moles of PO added=4 to 10) mono(2-ethylhexyl) ether, etc.

Specific examples of polyoxyalkylene ethers represented by the formula (4) include 1,5-pentamethylene glycol, 1,6-hexamethylene glycol, 1,7-heptamethylene glycol, 1,8-octamethylene glycol, 1,9-nonamethylene glycol, 1,10-decamethylene glycol, isoprene glycol, hexylene glycol, octanediol, diethylpropanediol, butylethylpropanediol, 2,4-diethyl-1,5-pentanediol and 3-methyl-1,5-pentanediol.

Preferred examples of polyoxyalkylene ethers represented by the formula (3) include diethylene glycol monobutyl ether, diethylene glycol monohexyl ether, diethylene glycol mono(2-ethylhexyl) ether, dipropylene glycol, tripropylene glycol, polyoxyethylene (the number of moles of EO added=2 to 10) octyl ether, polyoxyethylene (the number of moles of EO added=2 to 10) 2-ethylhexyl ether, etc.

Preferred examples of polyoxyalkylene ethers represented by the formula (4) include 1,6-hexamethylene glycol, hexylene glycol, 1,7-heptamethylene glycol, diethylpropanediol, butylethylpropanediol, 2,4-diethyl-1,5-pentanediol, 3-methyl-1,5-pentanediol, etc.

Polyoxyalkylene Glyceryl Ethers of the Formula (2)

In the polyoxyalkylene glyceryl ethers represented by the formula (2), $R^3$ is $C_2$ to $C_4$ alkylene, $R^4$ is hydrogen or $C_1$ to $C_{10}$ alkyl, and n is an integer of 0 to 8.

Specific examples of $R^3$ include $C_2$ to $C_4$ alkylene such as ethylene, propylene, isopropylene, butylene or isobutylene.

Examples of $R^4$ are preferably hydrogen, straight-chain $C_1$ to $C_{10}$ alkyl or branched-chain $C_3$ to $C_{10}$ alkyl, more preferably hydrogen, straight-chain $C_1$ to $C_8$ alkyl or branched-chain $C_3$ to $C_8$ alkyl.

The polyoxyalkylene glyceryl ethers of the formula (2) can be prepared by conventional processes, for example, by a process comprising polymerizing or copolymerizing (i.e., adding or co-adding) one or more $C_2$ to $C_4$ alkylene oxides to glycerin ($R^4$=H), or a process comprising reacting a polyoxyalkylene ether of the formula (3) ($R^5$=$C_1$ to $C_8$ alkyl) with glycol ($R^4$=$C_1$ to $C_{10}$ alkyl).

The number of polyoxyalkylene group or groups represented by n is 0 to 8, and is sometimes expressed in terms of the average value.

When a process comprising polymerizing or copolymerizing a $C_2$ to $C_4$ alkylene oxide with glycerin is employed, there is obtained, in addition to a compound represented by the formula (2), a polyoxyalkylene glyceryl ether wherein an alkylene oxide is added to the free hydroxyl groups of the glycerin skeleton in the formula (2). Even if such a compound is present, the polyoxyalkylene glyceryl ether of the formula (2) is effective. In particular, when a $C_2$ to $C_4$ alkylene oxide is added to glycerin, a mixture containing such a compound is obtained, and such mixture can also be used in the present invention.

The polyoxyalkylene glyceryl ether wherein an alkylene oxide is added to the free hydroxyl group of the glycerin skeleton in the formula (2) is represented by the formula (5)

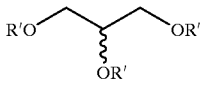

(5)

wherein the three R' groups may be the same or different and each represent a group —$(R^3O)_{n1}$—H wherein $R^3$ is as defined above, n1 is an integer of 0 to 8, the three n1 values are the same or different and the total of the three n1 values is 0 to 8, in particular from 2 to 8.

In the polyoxyalkylene glyceryl ethers of the formula (2), the following preferred combinations of $R^3$, $R^4$ and n are recommended:

$R^4$=H and n=0

$R^4$=H, $R^3$=$C_2$ to $C_4$ alkylene and n=1 to 8

$R^4$=$C_1$ to $C_8$ alkyl and n=0

$R^4$=$C_1$ to $C_8$ alkyl, $R^3$=$C_2$ to $C_4$ alkylene and n=1 to 8

Specific examples of $R^4$ include hydrogen, and additionally, methyl, ethyl, n-propyl, isopropyl, n-butyl, isobutyl, sec-butyl, n-pentyl, isopentyl, n-hexyl, isohexyl, n-heptyl, isoheptyl, 2-methylhexyl, n-octyl, 1-methylheptyl, 2-methylheptyl, 2-ethylhexyl, 2-octyl, isooctyl, n-nonyl, isononyl, 3,5,5-trimethylhexyl, n-decyl, isodecyl and the like. As preferable examples of $R^4$, recommended are hydrogen, methyl, ethyl, n-propyl, isopropyl, n-butyl, isobutyl, sec-butyl, n-pentyl, isopentyl, n-hexyl, isohexyl, n-heptyl, isoheptyl, 2-methylhexyl, n-octyl, 1-methylheptyl, 2-methylheptyl, 2-ethylhexyl, 2-octyl, isooctyl and the like.

Specific examples of polyoxyalkylene glyceryl ethers represented by the formula (2) are given below.

Examples of polyoxyalkylene glyceryl ethers wherein $R^4$ is hydrogen include glycerin, polyoxyethylene (the number of moles of EO added=1 to 8) glyceryl ether, polyoxypropylene (the number of moles of PO added=1 to 8) glyceryl ether, and polyoxybutylene (the number of moles of BO added=1 to 8) glyceryl ether. Herein, PO indicates propylene oxide and BO indicates butylene oxide.

Examples of polyoxyalkylene glyceryl ethers wherein $R^4$ is $C_1$ to $C_{10}$ alkyl include oxyethylene glyceryl methyl ether, dioxyethylene glyceryl methyl ether, trioxyethylene glyceryl methyl ether, tetraoxyethylene glyceryl methyl ether, pentaoxyethylene glyceryl methyl ether, hexaoxyethylene glyceryl methyl ether, heptaoxyethylene glyceryl methyl ether, octaoxyethylene glyceryl methyl ether, oxyethylene glyceryl ethyl ether, dioxyethylene glyceryl ethyl ether, trioxyethylene glyceryl ethyl ether, tetraoxyethylene glyceryl ethyl ether, pentaoxyethylene glyceryl ethyl ether, hexaoxyethylene glyceryl ethyl ether, heptaoxyethylene glyceryl ethyl ether, octaoxyethylene glyceryl ethyl ether, oxyethylene glycereyl propyl ether, dioxyethylene glyceryl propyl ether, trioxyethylene glyceryl propyl ether, tetraoxyethylene glyceryl propyl ether, pentaoxyethylene glyceryl propyl ether, hexaoxyethylene glyceryl propyl ether, heptaoxyethylene glyceryl propyl ether, octaoxyethylene glyceryl propyl ether, oxyethylene glyceryl butyl ether, dioxyethylene glyceryl butyl ether, trioxyethylene glyceryl butyl ether, tetraoxyethylene glyceryl butyl ether, pentaoxyethylene glyceryl butyl ether, hexaoxyethylene glyceryl butyl ether, heptaoxyethylene glyceryl butyl ether, octaoxyethylene glyceryl butyl ether, oxyethylene glyceryl pentyl ether, dioxyethylene glyceryl pentyl ether, trioxyethylene glyceryl pentyl ether, tetraoxyethylene glyceryl pentyl ether, pentaoxyethylene glyceryl pentyl ether, hexaoxyethylene glyceryl pentyl ether, heptaoxyethylene glyceryl pentyl ether, octaoxyethylene glyceryl pentyl ether, oxyethylene glyceryl hexyl ether, dioxyethylene glyceryl hexyl ether, trioxyethylene glyceryl hexyl ether, tetraoxyethylene glyceryl hexyl ether, pentaoxyethylene glyceryl hexyl ether, hexaoxyethylene glyceryl hexyl ether, heptaoxyethylene glyceryl hexyl ether, octaoxyethylene glyceryl hexyl ether, oxyethylene glyceryl heptyl ether, dioxyethylene glyceryl heptyl ether, trioxyethylene glyceryl heptyl ether, tetraoxyethylene glyceryl heptyl ether, pentaoxyethylene glyceryl heptyl ether, hexaoxyethylene glyceryl heptyl ether, heptaoxyethylene glyceryl heptyl ether, octaoxyethylene glyceryl heptyl ether, oxyethylene glyceryl octyl ether, dioxyethylene glyceryl octyl ether, trioxyethylene glyceryl octyl ether, tetraoxyethylene glyceryl octyl ether, pentaoxyethylene glyceryl octyl ether, hexaoxyethylene glyceryl octyl ether, heptaoxyethylene glyceryl octyl ether, octaoxyethylene glyceryl octyl ether, oxypropylene glyceryl methyl ether, dioxypropylene glyceryl methyl ether, trioxypropylene glyceryl methyl ether, tetraoxypropylene glyceryl methyl ether, pentaoxypropylene glyceryl methyl ether, hexaoxypropylene glyceryl methyl ether, heptaoxypropylene glyceryl methyl ether, octaoxypropylene glyceryl methyl ether, oxypropylene glyceryl ethyl ether, dioxypropylene glyceryl ethyl ether, trioxypropylene glyceryl ethyl ether, tetraoxypropylene glyceryl ethyl ether, pentaoxypropylene glyceryl ethyl ether, hexaoxypropylene glyceryl ethyl ether, heptaoxypropylene glyceryl ethyl ether, octaoxypropylene glyceryl ethyl ether, oxypropylene glyceryl propyl ether, dioxypropylene glyceryl propyl ether, trioxypropylene glyceryl propyl ether, tetraoxypropylene glyceryl propyl ether, pentaoxypropylene glyceryl propyl ether, hexaoxypropylene glyceryl propyl ether, heptaoxypropylene glyceryl propyl ether, octaoxypropylene glyceryl propyl ether, oxypropylene glyceryl butyl ether, dioxypropylene glyceryl butyl ether, trioxypropylene glyceryl butyl ether, tetraoxypropylene glyceryl butyl ether, pentaoxypropylene glyceryl butyl ether, hexaoxypropylene glyceryl butyl ether, heptaoxypropylene glyceryl butyl ether, octaoxypropylene glyceryl butyl ether, oxypropylene glyceryl pentyl ether, dioxypropylene glyceryl pentyl ether, trioxypropylene glyceryl pentyl ether, tetraoxypropylene glyceryl pentyl ether, pentaoxypropylene glyceryl pentyl ether, hexaoxypropylene glyceryl pentyl ether, heptaoxypropylene glyceryl pentyl ether, octaoxypropylene glyceryl pentyl ether, oxypropylene glyceryl hexyl ether, dioxypropylene glyceryl hexyl ether, trioxypropylene glyceryl hexyl ether, tetraoxypropylene glyceryl hexyl ether, pentaoxypropylene glyceryl hexyl ether, hexaoxypropylene glyceryl hexyl ether, heptaoxypropylene glyceryl hexyl ether, octaoxypropylene glyceryl hexyl ether, oxypropylene glyceryl heptyl ether, dioxypropylene glyceryl heptyl ether, trioxypropylene glyceryl heptyl ether, tetraoxypropylene glyceryl heptyl ether, pentaoxypropylene glyceryl heptyl ether, hexaoxypropylene glyceryl heptyl ether, heptaoxypropylene glyceryl heptyl ether, octaoxypropylene glyceryl heptyl ether, oxypropylene glyceryl octyl ether, dioxypropylene glyceryl octyl ether, trioxypropylene glyceryl octyl ether, tetraoxypropylene glyceryl octyl ether, pentaoxypropylene glyceryl octyl ether, hexaoxypropylene glyceryl octyl ether, heptaoxypropylene glyceryl octyl ether, octaoxypropylene glyceryl octyl ether and the like.

A mixture of a polyoxyalkylene ether of the formula (1) and a polyoxyalkylene glyceryl ether of the formula (2) is also preferably used as the hydroxyl-containing component of the agent for preventing oil filter clogging according to the present invention.

Preferred combinations of a polyoxyalkylene ether of the formula (1) and a polyoxyalkylene glyceryl ether of the formula (2) are as follows:

dipropylene glycol/trioxyethylene glyceryl ether dipropylene glycol/glycerin hexylene glycol/trioxyethylene glyceryl ether hexylene glycol/glycerin diethylene glycol monobutyl ether/trioxyethylene glyceryl ether diethylene glycol monobutyl ether/glycerin diethylene glycol monohexyl ether/trioxyethylene glyceryl ether diethylene glycol monohexyl ether/glycerin diethylene glycol mono(2-ethylhexyl) ether/trioxyethylene glyceryl ether diethylene glycol mono(2-ethylhexyl) ether/glycerin hexamethylene glycol/trioxyethylene glyceryl ether hexamethylene glycol/glycerin In the mixture of a polyoxyalkylene ether of the formula (1) and a polyoxyalkylene glyceryl ether of the formula (2), a preferred weight ratio of (A) the polyoxyalkylene ether of the formula (1) to (B) the polyoxyalkylene glyceryl ether of the formula (2) is (A):(B)=50:50 to 99:1, in particular 60:40 to 99:1.

Engine Oil Composition

The engine oil composition of the present invention contains an agent for preventing oil filter clogging, the agent comprising at least one hydroxyl-containing component selected from the group consisting of polyoxyalkylene ethers represented by the formula (1) and polyoxyalkylene glyceryl ethers represented by the formula (2).

As the base stock of the engine oil composition of the invention, there may be mentioned a base stock having a kinematic viscosity at 100° C. of 3 to 30 $mm^2/s$ and a viscosity index of 50 to 160, the base stock being a base stock comprising a mineral oil, a synthetic oil or a mixture thereof.

Examples of mineral oil base stocks include solvent-refined mineral oils, hydrogenated refined mineral oils and wax-isomerized oils.

Examples of synthetic oil base stocks include synthetic hydrocarbon oils, ester oils and ether oils.

Examples of synthetic hydrocarbon oils include poly-α-olefins, polybutenes, alkylbenzenes, alkylnaphthalenes and the like.

Examples of ester oils include aliphatic diesters and polyol esters.

It is recommended that the engine oil for use in the invention be selected so that the resulting engine oil composition of the invention has a total base number of 5 to 20 mg KOH/g.

In the engine oil composition of the invention, the agent for preventing oil filter clogging described hereinbefore can be used as such. The agent is added in a proportion of 0.01 to 2 wt. %, preferably 0.03 to 1 wt. %, based on the total weight of the engine oil composition. If the proportion of the agent is too small, the effect of inhibiting foots-like sludge formation tends to become small. On the other hand, if the proportion is too large, the agent is difficult to dissolve in the engine oil.

If desired, the engine oil composition of the invention may contain, for improving the properties thereof, one or more additives selected from antioxidants, anti-wear agents, ashless detergent-dispersants, metal detergents, defoaming agents and like general additives, and viscosity index improvers, metal corrosion inhibitors, metal deactivators, friction modifiers, pour point depressants, rust preventives and the like.

Examples of antioxidants include 2,6-di-t-butyl-paracresol, 4,4'-methylenebis(2,6-di-t-butylphenol) and like hindered phenol compounds; N-phenyl-α-naphtylamine, p,p'-dioctyldiphenylamine and like aromatic amine compounds; 4,4'-thiobis(6-t-butyl-3-methylphenol), phenothiazine and like sulfur compounds; phosphite compounds; zinc dialkyl dithiophosphate, zinc diallyl dithiophosphate and like zinc thiophosphate compounds; and zinc dialkyldithiocarbamate compounds. Any of these antioxidants may be added usually in a proportion of 0.1 to 5 wt. % relative to the base stock.

Examples of anti-wear agents include zinc dialkyl dithiophosphate, zinc diallyl dithiophosphate and like zinc thiophosphate compounds; olefin polysulfide, sulfurized fatty oils, sulfurized esters, and like organic sulfur compounds; and alkyl or allyl phosphate esters, alkyl or allyl phosphate esters and like organic phosphorus compounds. Any of these anti-wear agents may be added usually in a proportion of 0.05 to 5 wt. % relative to the base stock.

Examples of ashless dispersants include polyalkenyl succinimide, polyalkenyl succinic acid amide and polyalkenyl succinic acid ester. Any of these ashless dispersants may be added usually in a proportion of 1 to 10 wt. % relative to the base stock.

Examples of metal detergents include metal sulfonates, basic metal sulfonates, overbased metal sulfonates, metal phenates, basic metal phenates, overbased metal phenates, metal salicylates, basic metal salicylates, overbased metal salicylates, metal thioprophosphonates, metal phosphonates and metal carboxylates. Any of these metal detergents may be added usually in a proportion of 1 to 10 wt. % relative to the base stock.

Examples of defoaming agents include polydimethyl silicone and like silicone compounds. Any of these defoaming agents may be added usually in a proportion of 1 to 100 ppm relative to the base stock.

Examples of viscosity index improvers include polyalkyl methacrylate compounds, alkyl methacrylate-ethylene copolymer compounds, alkyl methacrylate-propylene copolymer compounds, polyisobutylene compounds, polyalkylstyrene compounds, ethylene-propylene copolymer compounds, styrene-butadiene copolymer compounds and styrene-maleic anhydride ester copolymer compounds. Any of these viscosity index improvers may be added usually in a proportion of 1 to 20 wt.% relative to the base stock.

Examples of pour point depressants include polyalkyl methacrylate, polyalkyl acrylate, polybutene, polyalkylstyrene and polyvinyl acetate. Any of these pour point depressants may be added in a proportion of 0.05 to 1 wt. % relative to the base stock.

Examples of friction modifiers include oleic acid ester of glycerin and like esters; oleic acid amide, stearic acid, oleic acid and like fatty acids; stearyl alcohol, oleyl alcohol and like alcohols; alkane-1,2-diols; glycerin monoalkyl ($C_{12}$–$C_{20}$) ether or glycerin monoalkenyl ethers; oleylamine and like amines; and molybdenum dithiocarbamate, molybdenum dithiophosphate and like organic molybdenum compounds. Any of these friction modifiers may be added usually in a proportion of 0.05 to 5 wt. % relative to the base stock.

Examples of metal deactivators and corrosion inhibitors include benzotriazole, 2,5-bis(n-dodecyldithio)-1,3,4-thiadiazole and like thiadiazole compounds. Any of these metal deactivators may be added usually in a proportion of 0.01 to 2 wt. % relative to the base stock.

Examples of rust preventives include sulfonic acid salts, carboxylic acid salts, organic amine soaps and sorbitan partial esters. Any of these rust preventives may be added usually in a proportion of 0.05 to 3 wt. % relative to the base stock.

Examples of surfactants include polyoxyalkylene alkyl ($C_{12}$–$C_{20}$) ethers, polyoxyalkylene alkenyl ($C_{12}$–$C_{20}$) ethers, polyoxyalkylamines and polyoxyethylene alkyl phenyl ethers. Any of these surfactants may be added usually in a proportion of 0.02 to 5 wt. % relative to the base stock.

The present invention further provides a method for preventing oil filter clogging, wherein the agent for preventing oil filter clogging according to the invention is used in a lubricating oil for an internal combustion engine equipped with an oil filter, or is used in a lubricating oil for other devices (such as hydraulic device and compressors) equipped with an oil filter, to thereby prevent oil filter clogging, in particular oil filter clogging caused by sludge formed from said lubricating oil in the presence of water.

Examples of lubricating oils to which the agent of the invention is applicable include gasoline engine oils, diesel engine oils, marine engine oils, agricultural tractor engine oils and like engine oils, hydraulic oils, compressor oils and oils for sliding surfaces.

The embodiments described above with respect to the engine oil composition of the invention are equally applicable to this aspect of the invention.

EXAMPLES

The following Examples and Comparative Examples illustrate the present invention in further detail, but in no way limit the scope of the invention. The engine oil compositions obtained in the Examples and Comparative Examples were subjected to the following filterability test to determine the likelihood of filter clogging owing to moisture mixed in the engine oil compositions.

Evaluation Test: Filterability Test

Two samples (Samples Nos. 1 and 2) each consisting of 99 ml of a test engine oil composition and 1.0 ml of distilled water were prepared. Each of the samples was placed in a 200-ml separatory funnel, and shaken for 5 minutes using a shaker for separatory funnels. The shaking was carried out by repeating up-and-down movements 250 times/min. After shaking, each of the samples was allowed to stand at room temperature for 24 hours, shaken again using the shaker for separatory funnels for 5 minutes, poured into a beaker and allowed to stand for 3 minutes until bubbles decreased.

Then, Sample No. 1 (100 ml) was poured into the cup of a filter device and suction-filtered at a reduced pressure of 500 mmHg to measure the time required for the sample to completely pass through the filter. The measurement is shown as a first filtration time.

Then, Sample No. 2 (100 ml) was poured into the cup, and the time required for the sample to completely pass through the filter was measured. The measurement is shown as a second filtration time.

The filter was not replaced for the second filtration time measurement. If a sample required 30 minutes or more to pass through the filter, the test was stopped and the result was rated as "failure". The filter used was a product of Advantec-Toyo, made of cellulose nitrate and having a pore size of 3.0 $\mu$m and a diameter of 47 mm.

<Rating>

For showing the filtration time, a period of 1 to 15 seconds is shown as 0.25 minute; a period of 16 to 30 seconds, as 0.50 minute; a period of 31 to 45 seconds, as 0.75 minute; and a period of 46 to 60 seconds, as 1.00 minute. When the filtration time was 30 minutes or more, the result is shown as "failure", and when the filtration time was less than 30 minutes, the measured filtration time is shown.

The engine oils used were as follows.

Engine oil A: meeting API CE standards and having a total base number of 9.7 mg KOH/g Engine oil B: meeting API CE standards and having a total base number of 8.2 mg KOH/g Engine oil C: meeting API CF-4 standards and having a total base number of 10.6 mg KOH/g Engine oil D: meeting API CF-4 standards and having a total base number of 8.1 mg KOH/g The following hydroxyl-containing components were used as agents for preventing oil filter clogging.

Diethylene glycol monobutyl ether (Nihon Nyukazai Kabushiki Kaisha)

Diethylene glycol monohexyl ether (Nihon Nyukazai Kabushiki Kaisha)

Diethylene glycol mono(2-ethylhexyl) ether (Nihon Nyukazai Kabushiki Kaisha)

Hexamethylene glycol (Nacalai Tesque, Inc.)

Dipropylene glycol (Nacalai Tesque, Inc.)

Polyoxyethylene (the average number of moles of EO added=7) octylether ("Conion W-70", a trial product of New Japan Chemical Co., Ltd.)

Polyoxyethylene (the average number of moles of EO added=2) octyl ether ("Conion D-22", a trial product of New Japan Chemical Co., Ltd.)

Trioxyethylene glyceryl ether ("Conion RG-30")

Polyoxyethylene (the average number of moles of EO added=4.5) nonylphenyl ether (Lion Corp.)

Polyoxyethylene (the average number of moles of EO added=4) lauryl ether ("Conion 275-EO40", a trial product of New Japan Chemical Co., Ltd.)

Polyoxyethylene (the average number of moles of EO added=7) lauryl ether ("Conion 275-EO70", a trial product of New Japan Chemical Co., Ltd.)

Examples 1 to 9

The engine oils and agents for preventing oil filter clogging shown in Table 1 were mixed in the proportions shown in Table 1 to prepare engine oil compositions. The compositions were tested for filterability. Table 1 shows the results.

In Table 1, the proportions of the components are shown in percentages by weight. The same applies to Tables 2 to 4. In Tables 1 to 4, "EO" means ethylene oxide and the numbers following "EO" indicate polymerization degrees of EO.

TABLE 1

| Example | 1 | 2 | 3 | 4 | 5 | 6 | 7 | 8 | 9 |
|---|---|---|---|---|---|---|---|---|---|
| Engine oil | | | | | | | | | |
| Engine oil A | 99.70 | 99.70 | 99.70 | 99.70 | 99.70 | 99.80 | 99.80 | 99.50 | 99.50 |
| Engine oil B | | | | | | | | | |
| Engine oil C | | | | | | | | | |
| Engine oil D | | | | | | | | | |
| Agent for preventing oil filter clogging | | | | | | | | | |
| Diethylene glycol monobutyl ether | 0.30 | | | | | | | | |
| Diethylene glycol monohexyl ether | | 0.30 | | | | | | | |
| Diethylene glycol mono(2-ethylhexyl) ether | | | 0.30 | | | | | | |
| Hexamethylene glycol | | | | 0.30 | | | | | |
| Hexylene glycol | | | | | 0.30 | 0.20 | | | |
| Dipropylene glycol | | | | | | | 0.20 | | |
| Polyoxyethylene (EO7) octyl ether | | | | | | | | 0.50 | |
| Polyoxyethylene (EO2) octyl ether | | | | | | | | | 0.50 |
| Filtration time (min) | | | | | | | | | |
| First filtration | 8.50 | 15.00 | 11.00 | 7.00 | 6.75 | 8.50 | 6.75 | 9.25 | 16.75 |
| Second filtration | 12.00 | 26.50 | 16.00 | 9.50 | 8.25 | 13.50 | 8.75 | 13.50 | 27.50 |

The proportions of the components are shown in percentages by weight.

Examples 10 to 16

The engine oils and agents for preventing oil filter clogging shown in Table 2 were mixed in the proportions shown in Table 2 to prepare engine oil compositions. The engine oil compositions were tested for filterability. Table 2 shows the results.

TABLE 2

| Example | 10 | 11 | 12 | 13 | 14 | 15 | 16 |
|---|---|---|---|---|---|---|---|
| Engine oil | | | | | | | |
| Engine oil A | | | | | | | |
| Engine oil B | 99.80 | | 99.80 | | | | |
| Engine oil C | | 99.90 | | 99.90 | 99.95 | | |
| Engine oil D | | | | | | 99.90 | 99.95 |
| Agent for preventing oil filter clogging | | | | | | | |
| Diethylene glycol monobutyl ether | | | | | | | |
| Diethylene glycol monohexyl ether | | | | | | | |
| Diethylene glycol mono(2-ethylhexyl) ether | | | | | | | |
| Hexamethylene glycol | | | | | | | |
| Hexylene glycol | | 0.10 | 0.20 | | | | |
| Dipropylene glycol | 0.20 | | | 0.10 | 0.05 | 0.10 | 0.05 |
| Polyoxyethylene (EO7) octyl ether | | | | | | | |
| Polyoxyethylene (EO2) octyl ether | | | | | | | |
| Filtration time (min) | | | | | | | |
| First filtration | 6.00 | 6.50 | 6.25 | 6.00 | 6.25 | 5.75 | 8.00 |
| Second filtration | 7.50 | 7.75 | 8.25 | 7.00 | 7.75 | 6.50 | 11.50 |

The proportions of the components are shown in percentages by weight.

Examples 17 to 21

The engine oils and agents for preventing oil filter clogging shown in Table 3 were mixed in the proportions shown in Table 3 to prepare engine oil compositions. The engine oil compositions were tested for filterability. Table 3 shows the results.

TABLE 3

| Example | 17 | 18 | 19 | 20 | 21 |
|---|---|---|---|---|---|
| Engine oil | | | | | |
| Engine oil A | 99.75 | 99.75 | 99.80 | 99.80 | |
| Engine oil B | | | | | |
| Engine oil C | | | | | 99.90 |
| Engine oil D | | | | | |
| Agent for preventing oil filter clogging | | | | | |
| Diethylene glycol monobutyl ether | | | | | |
| Diethylene glycol monohexyl ether | | | | | |
| Diethylene glycol mono(2-ethylhexyl) ether | | | | | |
| Hexamethylene glycol | | | | | |
| Hexylene glycol | | | | | |
| Dipropylene glycol | 0.175 | 0.20 | 0.16 | 0.14 | |
| Polyoxyethylene (EO7) octyl ether | | | | 0.06 | |
| Polyoxyethylene (EO2) octyl ether | | | | | |
| Glycerin | | 0.05 | 0.04 | | |
| Trioxyethylene glyceryl ether | 0.075 | | | | 0.10 |
| Filtration time (min) | | | | | |
| First filtration | 9.25 | 8.50 | 10.00 | 8.50 | 9.50 |
| Second filtration | 14.00 | 12.75 | 16.50 | 12.75 | 16.75 |

The proportions of the components are shown in percentages by weight.

Comparative Examples 1 to 11

The engine oils and conventional nonionic surfactants (polyoxyethylene nonylphenyl ether and polyoxyethylene lauryl ether) were mixed in the proportions shown in Table 4 to prepare engine oil compositions. The resulting engine oil compositions and the engine oils without surfactants were tested for filterability. Table 4 shows the results:

TABLE 4

| Comparative Example | 1 | 2 | 3 | 4 | 5 | 6 | 7 | 8 | 9 | 10 | 11 |
|---|---|---|---|---|---|---|---|---|---|---|---|
| Engine oil | | | | | | | | | | | |
| Engine oil A | 99.50 | 99.80 | | | 99.50 | 99.50 | 99.80 | 100 | | | |
| Engine oil B | | | 99.50 | 99.80 | | | | | 100 | | |
| Engine oil C | | | | | | | | | | 100 | |
| Engine oil D | | | | | | | | | | | 100 |
| Surfacatant | | | | | | | | | | | |
| Polyoxyethylene (EO4.5) nonyl phenyl ether | 0.50 | 0.20 | 0.50 | 0.20 | | | | | | | |
| Polyoxyethylene (EO4) lauryl ether | | | | | 0.50 | | | | | | |
| Polyoxyethylene (EO7) lauryl ether | | | | | | 0.50 | 0.20 | | | | |
| Filtration time (min) | | | | | | | | | | | |
| First filtration | Failure | Failure | Failure | Failure | Failure | Failure | Failure | Failure | Failure | Failure | Failure |
| Second filtration | — | — | — | — | — | — | — | — | — | — | — |

The proportions of the components are shown in percentages by weight.
— means that the second filtration was not carried out since the first filtration resulted in failure.

EFFECT OF THE INVENTION

The engine oil compositions containing hydroxyl-containing components according to the present invention are superior in filterability to compositions containing conventionally used nonionic surfactants. Thus, the compositions of the invention are remarkably valuable for practical use.

TABLE 4

| | Comparative Example | | | | | | | | | | |
|---|---|---|---|---|---|---|---|---|---|---|---|
| | 1 | 2 | 3 | 4 | 5 | 6 | 7 | 8 | 9 | 10 | 11 |
| Engine oil | | | | | | | | | | | |
| Engine oil A | 99.50 | 99.80 | | | 99.50 | 99.50 | 99.80 | 100 | | | |
| Engine oil B | | | 99.50 | 99.80 | | | | | 100 | | |
| Engine oil C | | | | | | | | | | 100 | |
| Engine oil D | | | | | | | | | | | 100 |
| Surfactant | | | | | | | | | | | |
| Polyoxyethylene (EO4.5) nonyl phenyl ether | 0.50 | 0.20 | 0.50 | 0.20 | | | | | | | |
| Polyoxyethylene (EO4) lauryl ether | | | | | 0.50 | | | | | | |
| Polyoxyethylene (EO7) lauryl ether | | | | | | 0.50 | 0.20 | | | | |
| Filtration time (min) | | | | | | | | | | | |
| First filtration | Failure | Failure | Failure | Failure | Failure | Failure | Failure | Failure | Failure | Failure | Failure |
| Second filtration | — | — | — | — | — | — | — | — | — | — | — |

The proportions of the components are shown in percentages by weight.
— means that the second filtration was not carried out since the first filtration resulted in failure.

What is claimed is:

1. An agent for preventing oil filter clogging, the agent being a mixture comprising:

(A) a polyoxyalkylene ether represented by the formula (1)

$$R^1O—(R^2O)m—H \quad (1)$$

wherein $R^1$ is hydrogen or $C_1$ to $C_8$ alkyl, $R^2$ is $C_2$ to $C_{10}$ alkylene, m is an integer of 1 to 10, and when m is 2 or more, the two or more $R^2$ group may be the same or different; and (B) a polyoxyalkylene glyceryl ether represented by the formula (2)

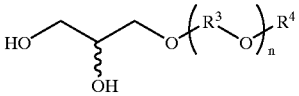

(2)

wherein $R^3$ is $C_2$ to $C_4$ alkylene, $R^4$ is hydrogen or $C_1$ to $C_{10}$ alkyl, n is an integer of 0 to 8, and when n is 2 or more, the two or more $R^3$ groups may be the same or different.

2. The agent according to claim 1 wherein (A) the polyoxyalkylene ether represented by the formula (1) and (B) the polyoxyalkylene glyceryl ether represented by the formula (2) are used in a weight ratio (A):(B)=50:50 to 99:1.

3. The agent according to claim 1 wherein the polyoxyalkylene ether (A) represented by the formula (1) is:

a compound represented by the formula (3)

$$R^5O—(R^6O)x—(R^7O)y—H \quad (3)$$

wherein $R^5$ is hydrogen or $C_1$ to $C_8$ alkyl, $R^6$ and $R^7$ may be the same or different and each represent $C_2$ to $C_4$ alkylene, and x and y may be the same or different and are each an integer of 0 to 10, provided that $1 \leqq x+y \leqq 10$; or a compound represented by the formula (4)

$$R^8O—(R^9O)x1—(R^{10}O)z—(R^{11}O)y1—H \quad (4)$$

wherein $R^8$ is hydrogen or $C_1$ to $C_8$ alkyl, $R^9$ and $R^{11}$ may be the same or different and each represent $C_2$ to $C_4$ alkylene, $R^{10}$ is $C_5$ to $C_{10}$ alkylene, x1 and y1 are each an integer of 0 to 10, and z is an integer of 1 to 10, provided that $1 \leqq x1+y1+z \leqq 10$.

4. The agent according to claim 3 wherein the polyoxyalkylene ether represented by the formula (1) is a compound represented by the formula (3) wherein $R^5$ is H, $R^6$ is $C_2$ to $C_4$ alkylene, x is 2 to 10 and y is 0; or a compound represented by the formula (3) wherein $R^5$ is H, $R^6$ is propylene, x is 2 to 8 and y is 0.

5. The agent according to claim 3 wherein the polyoxyalkylene ether represented by the formula (1) is a compound represented by the formula (4) wherein $R^8$ is H, $R^{10}$ is $C_5$ to $C_8$ alkylene, z is 1 to 4 and x1=y1=0.

6. The agent according to claim 1 wherein, in the formula (2), $R^4$ is H and n is 0, or $R^4$ is H and $R^3$ is $C_2$ to $C_4$ alkylene and n is 1 to 8.

7. The agent according to claim 1 wherein the polyoxyalkylene ether (A) is a compound represented by the formula (3)

$$R^5O—(R^6O)x—(R^7O)y—H \quad (3)$$

wherein $R^5$ is H, $R^6$ and $R^7$ may be the same or different and represent $C_2$ to $C_4$ alkylene, x is 2 to 10 and y is 0; or $R^5$ is H, $R^6$ and $R^7$ are propylene, x is 2 to 8 and y is 0.

8. The agent according to claim 1 wherein the polyoxyalkylene ether (A) is a compound represented by the formula (4)

$$R^8O—(R^9O)x1—(R^{10}O)z—(R^{11}O)y1—H \quad (4)$$

wherein $R^8$ is H, $R^{10}$ is $C_5$ to $C_8$ alkylene, $R^9$ and $R^{11}$ may be the same or different and represent $C_2$ to $C_4$ alkylene, z is 1 to 4 and x1=y1=0.

9. The agent according to claim 1 wherein the polyoxyalkylene glyceryl ether (B) is a compound represented by the formula (2) wherein $R^4$ is H and n is 0; or a compound represented by the formula (2) wherein $R^4$ is H and $R^3$ is $C_2$ to $C_4$ alkylene and n is 1 to 8.

10. The agent according to claim 1 which further comprises a compound represented by the formula (5)

(5)

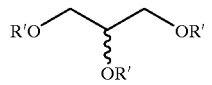

wherein the three R' groups may be the same or different and each represents a group —($R^3$O)n1—H wherein $R^3$ is as defined above, n1 is an integer of 0 to 8, the three n1 values maybe the same or different, and the total of the three n1 values is 2 to 8.

11. An engine oil composition comprising:

(I) an agent for preventing oil filter clogging comprising (A) polyoxyalkylene ethers represented by the formula (1)

$$R^1O—(R^2O)m—H \quad (1)$$

wherein R' is hydrogen, $R^2$ is $C_2$ to $C_{10}$ alkylene, m is an integer of 1 to 10, and when m is 2 or more, the two or more $R^2$ groups may be the same or different; or (B) polyoxyalkylene glyceryl ethers represented by the formula (2)

(2)

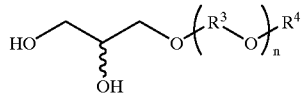

wherein $R^3$ is $C_2$ to $C_4$ alkylene, $R^4$ is hydrogen, n is an integer of 0 to 8, and when n is 2 or more, the two or more $R^3$ groups may be the same or different; and (II) at least one base stock selected from the group consisting of mineral oil base stocks and synthetic oil base stocks.

12. The engine oil composition according to claim 11 wherein the proportion of the agent for preventing oil filter clogging is 0.01 to 2 wt. % based on the total amount of the engine oil composition.

13. An engine oil composition comprising:

at least one base stock selected from the group consisting of mineral oil base stocks and synthetic oil base stocks and a mixture of:

(A) a polyoxyalkylene ether represented by the formula (1)

$$R^1O—(R^2O)m—H \quad (1)$$

wherein $R^1$ is hydrogen or $C_1$ to $C_8$ alkyl, $R^2$ is $C_2$ to $C_{10}$ alkylene, m is an integer of 1 to 10, and when m is 2 or more, the two or more $R^2$ groups may be the same of different; and (B) a polyoxyalkylene glyceryl ether represented by the formula (2)

(2)

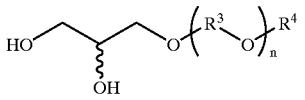

wherein $R^3$ is $C_2$ to $C_4$ alkylene, $R^4$ is hydrogen or $C_1$ to $C_{10}$ alkyl, n is an integer of 0 to 8, and when n is 2 or more, the two or more $R^3$ groups may be the same or different.

14. The engine oil composition according to claim 13 wherein the polyoxyalkylene ether (A) represented by the formula (1) and the polyoxyalkylene glyceryl ether (B) represented by the formula (2) are used in a weight ratio (A):(B)=50:50 to 99:1.

15. The engine oil composition according to claim 13 wherein the polyoxyalkylene ether represented by the formula (1) is a compound represented by the formula (3)

$$R^5O—(R^6O)x—(R^7O)y—H \quad (3)$$

wherein $R^5$ is hydrogen, $R^6$ and $R^7$ may be the same or different and each represent $C_2$ to $C_4$ alkylene, and x and y may be the same or different and are each an integer of 0 to 10, provided that $1 \leqq x+y \leqq 10$; or a compound represented by the formula (4)

$$R^8O—(R^9O)x1—(R^{10}O)z—(R^{11}O)y1—H \quad (4)$$

wherein $R^8$ is hydrogen, $R^9$ to $R^{11}$ may be the same or different and each represent $C_2$ to $C_4$ alkylene, $R^{10}$ is $C_5$ to $C_{10}$ alkylene, x1 and y1 are each an integer of 0 to 10, and z is an integer of 1 to 10, provided that $1 \leqq x1+y1+z \leqq 10$.

16. The engine oil composition according to claim 15 wherein the polyoxyalkylene ether represented by the formula (1) is a compound represented by the formula (3) wherein $R^5$ is H, $R^6$ is $C_2$ to $C_4$ alkylene and x is 2 to 10 and y is 0; or a compound represented by the formula (3) wherein $R^5$ is H, $R^6$ is propylene and x is 2 to 8 and y is 0.

17. The engine oil composition according to claim 15 wherein the polyoxyalkylene ether represented by the formula (1) is a compound represented by the formula (4) wherein $R^8$ is H, $R^{10}$ is $C_5$ to $C_8$ alkylene, z is 1 to 4 and x1=y1=0.

18. The engine oil composition according to claim 13 wherein, in the formula (2), $R^4$ is H and n is 0, or $R^4$ is H, $R^3$ is $C_2$ to $C_4$ alkylene and n is 1 to 8.

19. The engine oil composition according to claim 11 wherein the hydroxyl-containing component is a compound represented by the formula (3)

$$R^5O—(R^6O)x—(R^7O)y—H \quad (3)$$

wherein $R^5$ is H, $R^6$ is $C_2$ to $C_4$ alkylene, x is 2 to 10 and y is 0; or $R^5$ is H, $R^6$ is propylene, x is 2 to 8 and y is 0.

20. The engine oil composition according to claim 11 wherein the hydroxyl-containing component is a compound represented by the formula (4)

$$R^8O—(R^9O)x1—(R^{10}O)z—(R^{11}O)y1—H \quad (4)$$

wherein $R^8$ is H, $R^{10}$ is $C_5$ to $C_8$ alkylene, $R^9$ and $R^{11}$ may be the same or different and represent $C_2$ to $C_4$ alkylene, z is 1 to 4 and x1=y1=0.

21. The engine oil composition according to claim 11 wherein the hydroxyl-containing component is a compound represented by the formula (2) wherein $R^4$ is H and n is 0, or a compound represented by the formula (2) wherein $R^4$ is H, $R^3$ is $C_2$ to $C_4$ alkylene and n is 1 to 8.

22. The engine oil composition according to claim 11 which further comprises a compound represented by the formula (5)

(5)

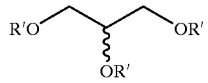

wherein the three R' groups may be the same or different and each represent a group —($R^3$O)n1—H wherein $R^3$ is as defined above, n1 is an integer of 0 to 8, the three n1 values may be the same or different, and the total of the three n1 values is 2 to 8.

23. A method for preventing clogging of an oil filter for filtering engine oils, the method comprising adding an agent for preventing oil filter clogging to the engine oil, the agent comprising at least one hydroxyl-containing component selected from the group consisting of:

(A) polyoxyalkylene ethers represented by the formula (1)

$$R^1O—(R^2O)m—H \quad (1)$$

wherein $R^1$ is hydrogen or $C_1$ to $C_8$ alkyl, $R^2$ is $C_2$ to $C_{10}$ alkylene, m is an integer of 1 to 10, and when m is 2 or more, the two or more $R^2$ groups may be the same or different; and (B) polyoxyalkylene glyceryl ethers represented by the formula (2)

(2)

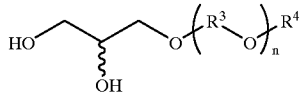

wherein $R^3$ is $C_2$ to $C_4$ alkylene, $R^4$ is hydrogen or $C_1$ to $C_{10}$ alkyl, n is an integer of 0 to 8, and when n is 2 or more, the two or more $R^3$ groups may be the same or different.

24. A method according to claim 23 wherein the hydroxyl-containing component is a mixture of (A) a polyoxyalkylene ether represented by the formula (1) and (B) a polyoxyalkylene glyceryl ether represented by the formula (2).

25. The method according to claim 24 wherein the polyoxyalkylene ether (A) represented by the formula (1) and the polyoxyalkylene glyceryl ether (B) represented by the formula (2) are used in a weight ratio (A):(B)=50:50 to 99:1.

26. The method according to claim 24, wherein the polyoxyalkylene ether represented by the formula (1) is a compound represented by the formula (3)

$$R^5O—(R^6O)x—(R^7O)y—H \quad (3)$$

wherein $R^5$ is hydrogen or $C_1$ to $C_8$ alkyl, $R^6$ and $R^7$ may be the same or different and each represent $C_2$ to $C_4$ alkylene, and x and y may be the same or different and are each an integer of 0 to 10, provided that $1 \leqq x+y \leqq 10$; or a compound represented by the formula (4)

$$R^8O—(R^9O)x1—(R^{10}O)z—(R^{11}O)y1—H \quad (4)$$

wherein $R^8$ is hydrogen or $C_1$ to $C_8$ alkyl, $R^9$ and $R^{11}$ may be the same or different and each represent $C_2$ to $C_4$ alkylene, $R^{10}$ is $C_5$ to $C_{10}$ alkylene, x1 and y1 are each an integer of 0 to 10, and z is an integer of 1 to 10, provided that $1 \leqq x1+y1+z \leqq 10$.

27. The method according to claim 26 wherein the polyoxyalkylene ether represented by the formula (1) is a compound represented by the formula (3) wherein $R^5$ is H, $R^6$ is $C_2$ to $C_4$ alkylene, x is 2 to 10 and y is 0; or a compound represented by the formula (3) wherein $R^5$ is H, $R^6$ is propylene, x is 2 to 8 and y is 0.

28. The method according to claim 26 wherein the polyoxyalkylene ether represented by the formula (1) is a compound represented by the formula (4) wherein $R^8$ is H, $R^{10}$ is $C_5$ to $C_8$ alkylene, z is 1 to 4 and x1=y1=0.

29. The method according to claim 24 wherein, in the formula (2), $R^4$ is H and n is 0, or $R^4$ is H, $R^3$ is $C_2$ to $C_4$ alkylene and n is 1 to 8.

30. The method according to claim 23 wherein the hydroxyl-containing component is a compound represented by the formula (3)

$$R^5O—(R^6O)x—(R^7O)y—H \quad (3)$$

wherein $R^5$ is H, $R^6$ is $C_2$ to $C_4$ alkylene, x is 2 to 10 and y is 0; or $R^5$ is H, $R^6$ and $R^7$ are propylene, x is 2to8 and y is 0.

31. The method according to claim 23 wherein the hydroxyl-containing component is a compound represented by the formula (4)

$$R^8O—(R^9O)x1—(R^{10}O)z—(R^{11}O)y1—H \quad (4)$$

wherein $R^8$ is H, $R^{10}$ is $C_5$ to $C_8$ alkylene, $R^9$ and $R^{11}$ may be the same or different and represent $C_2$ to $C_4$ alkylene, z is 1 to 4 and x1=y1=0.

32. The method according to claim 23 wherein the hydroxyl-containing component is a compound represented by the formula (2) wherein $R^4$ is H and n is 0, or a compound represented by the formula (2) wherein $R^4$ is H, $R^3$ is $C_2$ to $C_4$ alkylene and n is 1 to 8.

33. The method according to claim 23 wherein the agent for preventing oil filter clogging further contains a compound represented by the formula (5)

(5)

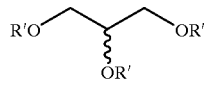

wherein the three R' groups may be the same or different and each represent a group —$(R^3O)$n1—H wherein $R^3$ is as defined above, n1 is an integer of 0 to 8, the three n1 values may be the same or different, and the total of the three n1 values is 2 to 8.

34. An engine oil composition comprising:

at least one base stock selected from the group consisting of mineral oil base stocks and synthetic oil base stocks; and a mixture of:

(A) a polyoxyalkylene ether represented by the formula (1)

$$R^1O—(R^2O)m—H \quad (1)$$

wherein $R^1$ is hydrogen, $R^2$ is $C_2$ to $C_{10}$ alkylene, m is an integer of 1 to 10, and when m is 2 or more, the two or more $R^2$ groups may be the same or different; and (B) a polyoxyalkylene glyceryl ether represented by the formula (2)

(2)

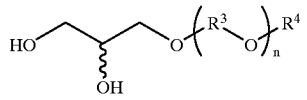

wherein $R^3$ is $C_2$ to $C_4$ alkylene, $R^4$ is hydrogen, n is an integer of 0 to 8, and when n is 2 or more, the two or more $R^3$ groups may be the same or different.

* * * * *